US008210400B2

(12) United States Patent
Scheindel

(10) Patent No.: US 8,210,400 B2
(45) **Date of Patent: *Jul. 3, 2012**

(54) VALVE FOR USE IN A CONTAINER WHICH EMPLOYS PRESSURE TO DISPENSE PRODUCT

(75) Inventor: Christian T. Scheindel, Randolph Center, VT (US)

(73) Assignee: Christian T. Scheindel, Randolph Center, VT (US)

( * ) Notice: Subject to any disclaimer, the term of this patent is extended or adjusted under 35 U.S.C. 154(b) by 915 days.

This patent is subject to a terminal disclaimer.

(21) Appl. No.: 12/184,264

(22) Filed: Aug. 1, 2008

(65) Prior Publication Data

US 2008/0290307 A1 Nov. 27, 2008

Related U.S. Application Data

(63) Continuation-in-part of application No. 12/009,518, filed on Jan. 18, 2008, which is a continuation-in-part of application No. 11/842,632, filed on Aug. 21, 2007, now Pat. No. 7,775,409, and a continuation-in-part of application No. 11/842,640, filed on Aug. 21, 2007, now Pat. No. 7,832,597, which is a continuation-in-part of application No. 11/334,716, filed on Jan. 18, 2006, now abandoned, which is a continuation-in-part of application No. 10/882,625, filed on Jun. 30, 2004, now abandoned, which is a continuation of application No. 10/816,969, filed on Apr. 2, 2004, now abandoned, which is a continuation of application No. 10/285,238, filed on Oct. 31, 2002, now abandoned.

(51) Int. Cl.
*B65D 83/00* (2006.01)

(52) U.S. Cl. ..... 222/402.22; 222/389; 222/402.24

(58) Field of Classification Search ..... 222/402.1, 222/402.15, 402.22, 402.23, 402.24, 402.25, 222/399, 389

See application file for complete search history.

(56) References Cited

U.S. PATENT DOCUMENTS

| | | | |
|---|---|---|---|
| 2,614,597 | A | 10/1952 | Magnus |
| 2,808,806 | A | 10/1957 | Tysinger |
| 2,839,225 | A | 6/1958 | Soffer et al. |
| 2,914,224 | A | 11/1959 | Michel |
| 2,957,610 | A | 10/1960 | Michel |
| 2,965,270 | A | 12/1960 | Soffer et al. |
| 2,994,461 | A | 8/1961 | Michel |
| 3,089,625 | A | 5/1963 | Sorber |

(Continued)

OTHER PUBLICATIONS

PCT Transmittal of the International Search Report and the Written Opinion Dated Nov. 3, 2008.

*Primary Examiner* — Kevin P Shaver
*Assistant Examiner* — Melvin Cartagena
(74) *Attorney, Agent, or Firm* — Cowan, Liebowitz & Latman

(57) ABSTRACT

A valve for a pressurized dispensing container has a resilient annular grommet that surrounds a valve stem. The grommet has a lower segment which engages an elongate valve stem opening with a slight interference fit to provide user controllable metering of the product being dispensed. A recess in the lower surface of the grommet contains the stem button from the closed state to the fully open state to provide stability for the stem. The upper portion of the grommet has a restoring boot to assure that the valve is returned to its closed state once manual force is removed from the valve. A boot flange and stem recess engagement together with other dimensional relationships assures that the boot provide the required restoring force throughout the dispensing of product.

25 Claims, 8 Drawing Sheets

U.S. PATENT DOCUMENTS

| | | | |
|---|---|---|---|
| 3,255,926 | A | 6/1966 | Modderno |
| 3,401,849 | A | 9/1968 | Weber, III |
| 3,415,426 | A | 12/1968 | Klevland |
| 4,165,825 | A | 8/1979 | Hansen |
| 4,522,318 | A | 6/1985 | Del Bon |
| 4,752,020 | A | 6/1988 | Grueter et al. |
| 4,791,723 | A | 12/1988 | Jacobson |
| 4,805,813 | A | 2/1989 | Metcoff et al. |
| 5,040,705 | A | 8/1991 | Snell |
| 5,070,611 | A | 12/1991 | Derin et al. |
| 5,450,983 | A | 9/1995 | Stern et al. |
| 5,456,386 | A | 10/1995 | Jesswein |
| 5,785,301 | A | 7/1998 | Scheindel |
| 5,787,301 | A | 7/1998 | Arakawa et al. |
| 5,927,563 | A | 7/1999 | Kellner |
| 6,321,951 | B1 | 11/2001 | Frutin |
| 6,340,103 | B1 | 1/2002 | Scheindel et al. |
| 6,371,338 | B1 | 4/2002 | Klein et al. |
| 6,425,503 | B1 | 7/2002 | Scheindel |
| 6,474,510 | B2 | 11/2002 | Frutin |
| 6,685,064 | B2 | 2/2004 | Frutin |
| 6,820,777 | B2 | 11/2004 | Frutin |
| 6,918,516 | B2 | 7/2005 | Frutin |
| 138,178 | A1 | 6/2006 | Scheindel |
| 2004/0256418 | A1 | 12/2004 | Scheindel |
| 2006/0138178 | A1 | 6/2006 | Scheindel |

ALL DIMENSIONS ARE IN INCHES

VALVE FOR USE IN A CONTAINER WHICH EMPLOYS PRESSURE TO DISPENSE PRODUCT

REFERENCE TO RELATED APPLICATIONS

This application is a continuation-in-part of Ser. No. 12/009,518 filed 18 Jan. 2008 which is a continuation-in-part of Ser. No. 11/842,632 filed 21 Aug. 2007 and Ser. No. 11/842,640 filed 21 Aug. 2007; which applications in turn are continuations-in-part of Ser. No. 11/334,716 filed 18 Jan. 2006, which in turn is a continuation-in-part of Ser. No. 10/882,625 filed 30 Jun. 2004 now abandoned, which in turn is a continuation of Ser. No. 10/816,969 filed 2 Apr. 2004, now abandoned, and which in turn is a continuation of Ser. No. 10/285,238 filed 31 Oct. 2002, now abandoned; the entire disclosures of which are hereby incorporated by reference.

BACKGROUND OF THE INVENTION

Background and Objects

Vast numbers of hand held pressurized containers for dispensing products such as gel shave are used by consumers and industry. Normally a finger or lever actuated valve is used to permit dispensing product from a nozzle on the top of the container. A hydrocarbon propellant is usually used. Wide spread concern has been expressed about the ecological effect of these propellants. Yet such propellants are useful because they include a liquid reservoir that supplements the pressurized gas as product is dispensed and the propellant chamber expands.

A major object of this invention is to provide a valve that facilitates use of a compressed gas such as nitrogen or air as the propellant in these pressurized dispensing containers. A major effect of using compressed gas, which does not have a liquid reservoir, is that the pressure decreases as product is dispensed. There is a product chamber and a pressurized propellant chamber. These two chambers are separated by a movable piston or by a collapsible bag. The product chamber decreases as product is dispensed and the propellant chamber increases. Thus propellant pressure decreases.

A major reasons why compressed nitrogen or air is not used is that the pressure decrease as product is dispensed makes it difficult for the user to maintain a steady flow of product.

It is further important that the valve provide a feel and function close to that of current pressurized dispensing cans in order to gain market acceptance.

It is further important that the valve be adapted to high speed, high volume production.

Essentially the design objectives of a valve that will be acceptable are at least to:

provide an even dispensing of product from beginning to end of dispensing.

minimize an initial dispensing spurt of product.

provide a comfortable user dispensing pressure; such as five pounds.

employ a minimum number of parts to keep part and assembly costs low.

provide a design which makes possible high speed, low cost assembly.

provide a design which minimizes malfunction.

provide a design which can achieves these results by employing available, reasonable cost materials.

The valve design provides optimum trade offs between various parameters and objectives such as a trade off between the requirement that the valve be readily opened through hand pressure of the user and sealing effectiveness. Another trade off involves.

a balance between preventing leakage of product around the valve button and valve stem when in the closed state yet providing a relatively easy to open valve.

Applicant's U.S. Pat. Nos. 5,785,301 and 6,425,503 and 6,340,103 are representative of prior valve designs for use in hand held pressurized containers dispensing a variety of products.

The valve designs to which this invention is addressed have a sealing grommet which surrounds the valve stem. When the valve is closed, the lower portion of the sealing grommet encases the product openings in the valve stem and prevents product from being dispensed. As the valve is opened the valve stem openings are exposed to product. The constant pressure maintained by a hydro carbon propellant with its liquid reservoir, means that product can be dispensed at a constant rate over the dispensing range of the pressurized product.

It is a further and related purpose of this invention to meet the above objectives in a design which minimizes the additional cost of fabricating the valve so as to make this improved valve economically viable or attractive in a wide range of pressurized dispensing containers.

It is a further related purpose of this invention to provide such an improvement such that present manufacturing and assembly processes can readily be adapted to assembling the valve.

BRIEF DESCRIPTION

In brief, the embodiment described herein is to a valve having a mounting cup, an axially movable valve element and a resilient sealing grommet surrounding the stem of the valve element. The valve stem has sidewall openings. When the valve is axially depressed, these openings are in communication with the product to be dispensed in the pressurized can on which the valve is mounted. The product, under pressure, is forced through the valve stem openings up through a central passageway in a tubular valve stem and out of whatever dispensing actuator or nozzle is appropriate for the product being dispensed. In addition to the valve stem with its sidewall openings, there is a button at the base of the valve stem that abuts under pressure against a horizontal surface of the sealing grommet in order to assure sealing of the product when in the closed state.

The sealing grommet has an annular interior surface that surrounds the valve stem and has an interference fit relationship with the lower portion of the valve stem from the button to at least the top of the dispensing openings in the valve stem. This interference fit is required to assure that when the stem is depressed to expose a portion of the openings to product, the result is a partial opening with a less than full dispensing rate.

In barrier containers, using compressed nitrogen or air, as product is dispensed, the pressure decreases. Depressing the valve to expose a portion of the valve stem opening as a function of the loss of pressure enables a relatively satisfactory steady dispensing of product during the course of dispensing product. But for this to work, the grommet has to effectively seal off the unexposed portion of the valve stem opening. The interference fit assures that partial opening result.

The dispensing openings in the stem are elongate in the axial direction to facilitate control over exposing only a proportion of the opening. The openings preferably have an inverted triangular shape and thus provide a more sensitive control over the effective opening as the stem is depressed.

The sealing grommet has a recess in its base for receiving the valve button. The relationship between the button diameter and the grommet recess diameter is a slip fit. The result is that the walls of the grommet recess assure stability of the valve by minimizing any tendency of the valve to tilt.

Recesses in the edge of the button allow product to travel past the edge of the button to reach the valve stem sidewall openings when the valve is open. The recesses in the button are at least equal in area to the valve stem openings so as to avoid further restriction on the flow of the product to be dispensed.

At the upper portion of the sealing grommet is a boot. The boot has a foot that provides a radially inwardly extending annular flange at the upper edge of the boot and a mating annular recess on the stem. Since the upper surface of the foot abuts the stem shoulder, the annular recess on the stem has to be adjacent to and below the stem shoulder.

To minimize the risk of having the foot snap over the shoulder and thus disable the valve, it is important that the flange provided by the foot is fully inserted in the recess on stem wall. To assure this full engagement, the inner diameter of the boot below the foot flange has a slight interference relationship with the stem wall.

It is believed that one reason why the foot flange to stem recess design is effective is that the downwardly facing surface of the stem which engages the upwardly facing surface of the foot is by this flange recess design extended radially inward. Accordingly, the net force exerted on the boot is brought radially inward. This relationship provides not only a greater surface over which stem to foot contact is maintained but also appears to favorably affect the resolution of forces which otherwise tend to pull the upper edge of the boot out and around the engaging shoulder. The annular leg of the boot has a concave inner surface and complementary convex outer surface. The inner surface extends downward further than does the outer surface. This boot leg design provides a more assured collapse of the boot leg during opening and thus is part of what permits easy opening of the valve.

Terminology

Nominal Clearance and Nominal Interference

The term Nominal is used to refer to structural relations where the design values or target values of engaging structures are selected in part with an eye to the expected manufacturing tolerances and in part to prevent binding or to assure engagement. These dimensional relations are particularly important to assure proper engagement between foot flange and stem recess.

For example, the depth of the stem recess is nominally greater than the length of the boot flange and the thickness of the inner end of the stem recess is nominally greater than the thickness of the end of the boot flange.

These nominal clearance relations assure that, when manufacturing tolerances are taken into account, there will be room for the flange to fit fully within the recess in both closed and open valve states.

The above examples are for a given embodiment. The amount of the nominal clearances will be a function of experience with particular materials, manufacturing machines and the size of the valve.

Up and Down; Lower and Upper

The terms up and down as well as relational terms lower and upper are used to refer to the relations when a container having a valve is sitting on the shelf. In use, the container is usually tilted or upside down when used. It should be understood that these terms are used to provide easier description and refer to the valve in a container sitting on a shelf.

The open state of the valve is normally used to refer to both fully open and partially open valve conditions.

A mil is a thousandth of an inch (0.001 inches).

BRIEF DESCRIPTION OF THE FIGURES

FIG. 2 shows the stem shoulder 50 engaging the upper surface of the foot 46 and also shows the foot flange and stem recess engagement. This engagement is best seen from FIG. 8.

FIG. 4 shows the annular recess 54 below the shoulder, which recess engages the boot flange.

FIG. 7 shows the leg 42 having inner and outer curved surfaces in which the inner curvature extends below the outer curvature. FIG. 7 also shows the inwardly facing annular foot flange 66 at the upper edge of the boot 46. This is the flange that engages the annular recess 54 in the stem.

DESCRIPTION OF THE PREFERRED EMBODIMENTS

Figure 1:
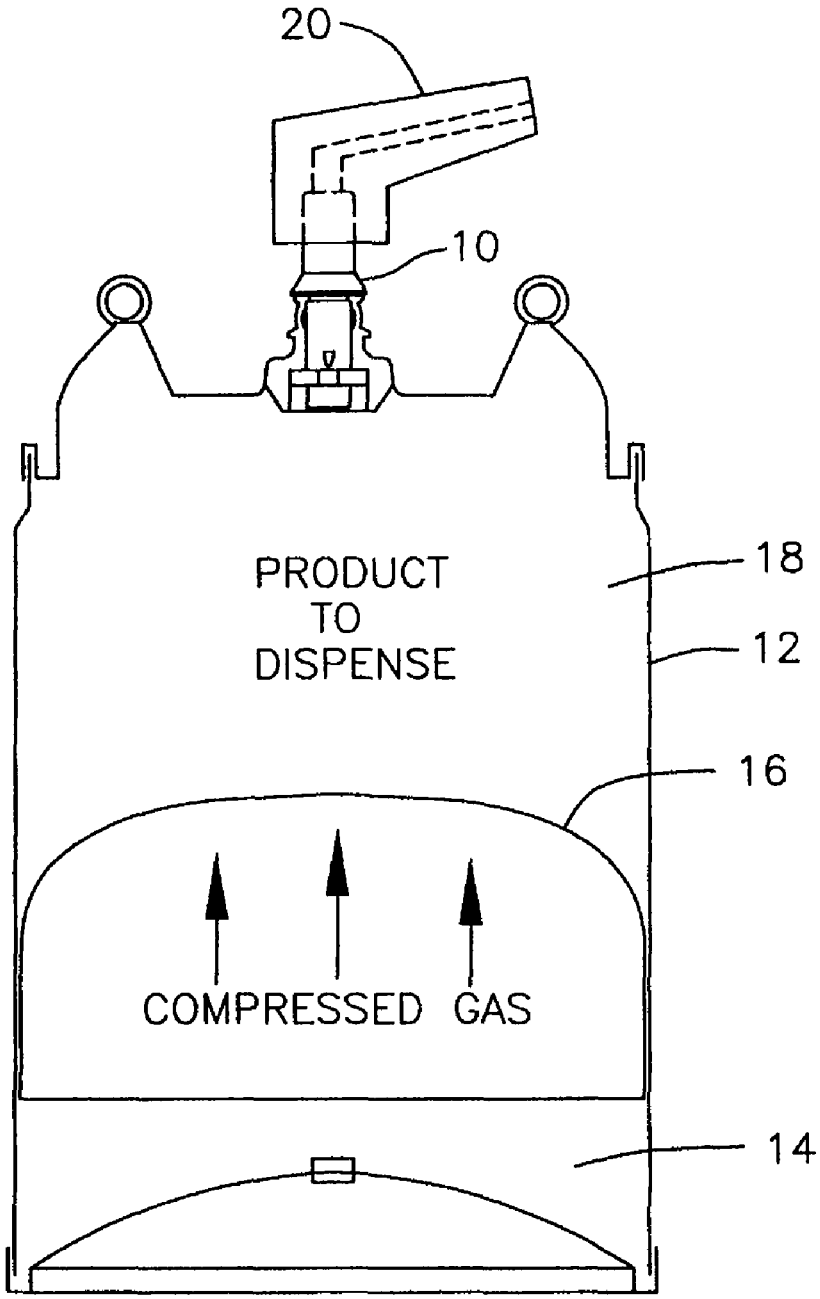
FIG. 1 is a highly schematic illustration of the valve 10 of this invention mounted on a dispensing can 12 having a piston barrier 16 between propellant and product.

The FIGS. essentially illustrate a single embodiment. FIG. 1 is a schematic illustration of the assembly of the valve 10 and the container 12. The compressed gas propellant 14 is below the piston 16 and the product to be dispensed 18 is above the piston 16. A combined actuator and nozzle 20 is mounted on the valve 10.

Figure 2:
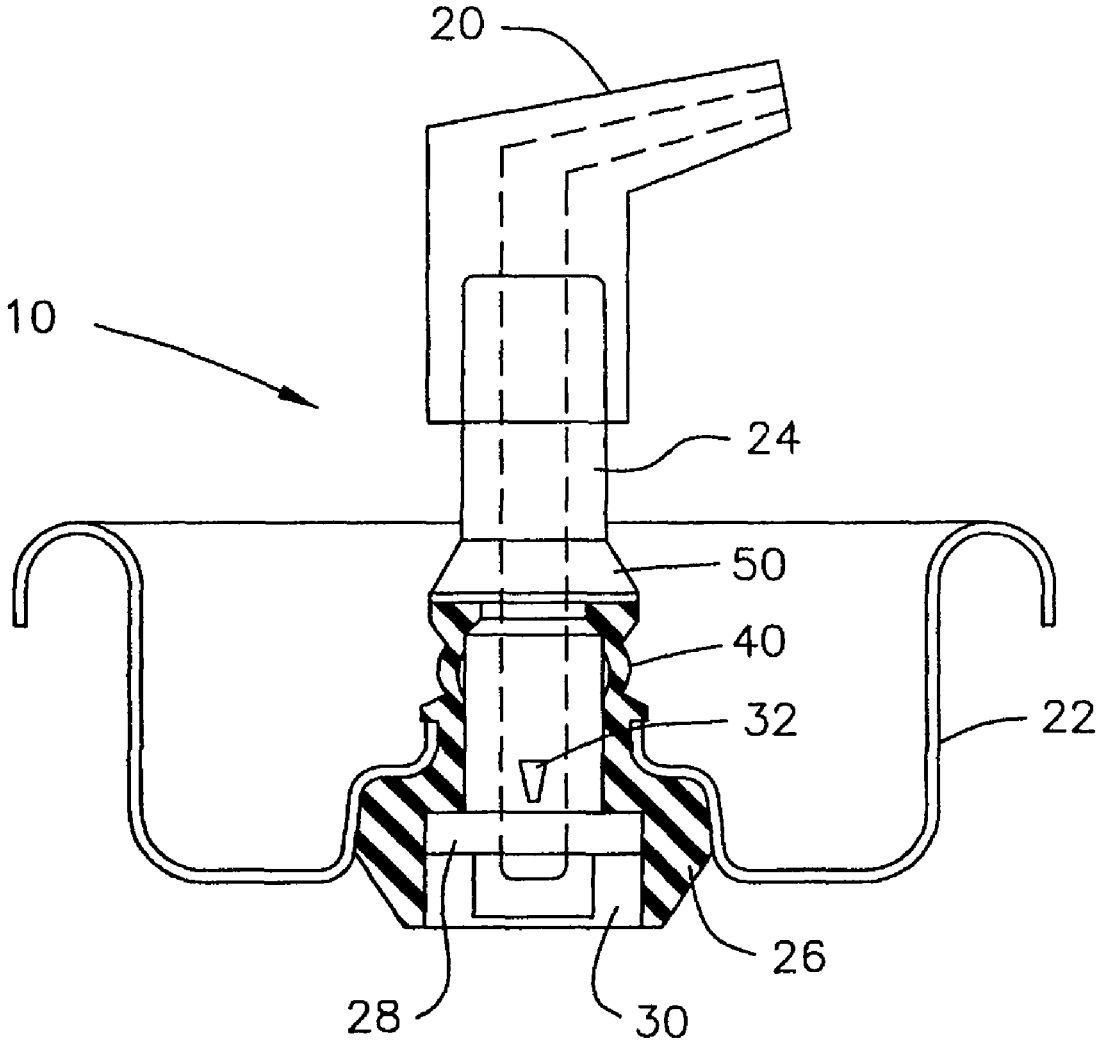
FIG. 2 is a schematic view, in partial longitudinal sectional view of the valve of this invention in a closed state.

As shown in FIG. 2, the valve 10 is a three piece valve assembly. It is constituted by a mounting cup 22, a movable valve element 24 and a resilient annular sealing grommet 26. The movable valve element 24 is also referred to as a valve stem 24. Both stem 24 and grommet 26 have a vertical axis and respective vertical bores 52 and 56.

Figure 3:
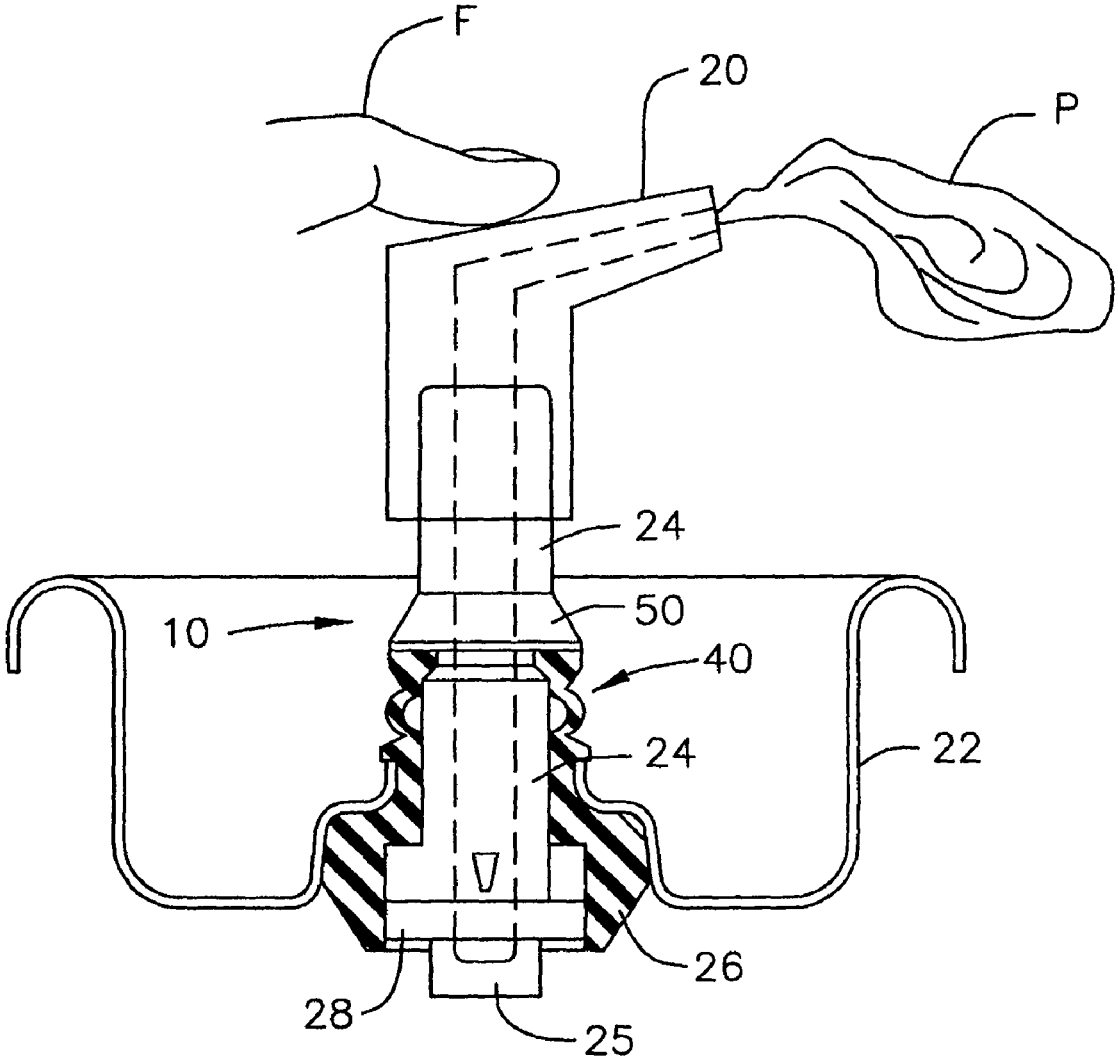
FIG. 3 is a schematic view, similar to that of FIG. 1, except that it shows the valve in an open state, that is in a product dispensing state.

With reference to FIGS. 2 and 3, the finger F operated actuator 20 is used to move the valve from a FIG. 2 closed state to its FIG. 3 open state. In the open state, product P is dispensed because of the pressure within the container to which the valve is mounted.

A lower portion of stem 24 has a button 28 which fits into a recess 30 in the base of the grommet 26. The valve stem has two openings 32 (one of which is shown) through which product is dispensed when the valve is open. When the valve is in the closed position shown in FIG. 2, the top of the button 34 abuts against the top surface 36 of the grommet recess 30 thereby effectively sealing the contents of the container from access to the valve openings 32. When the valve stem 24 is depressed, as shown in FIG. 3, the button 28 moves down within the recess 30.

In that open state, edge recesses or openings 38 (see FIG. 5) in the button 28 permit communication from within the container through these openings 38 to the valve stem openings 32 so that product can be dispensed through the center passageway 52 in the stem 24 and out the nozzle 20. In the fully open state the button 28 remains within the grommet recess 30. A slip fit relation between button 28 and the wall of the recess 30 stabilizes the position of the button and stem.

The lower stem extension 25 is to facilitate handling in assembly. The bore 52 extends below the openings 32 to reduce the amount of plastic used in molding and to facilitate cooling after molding.

Figure 7:
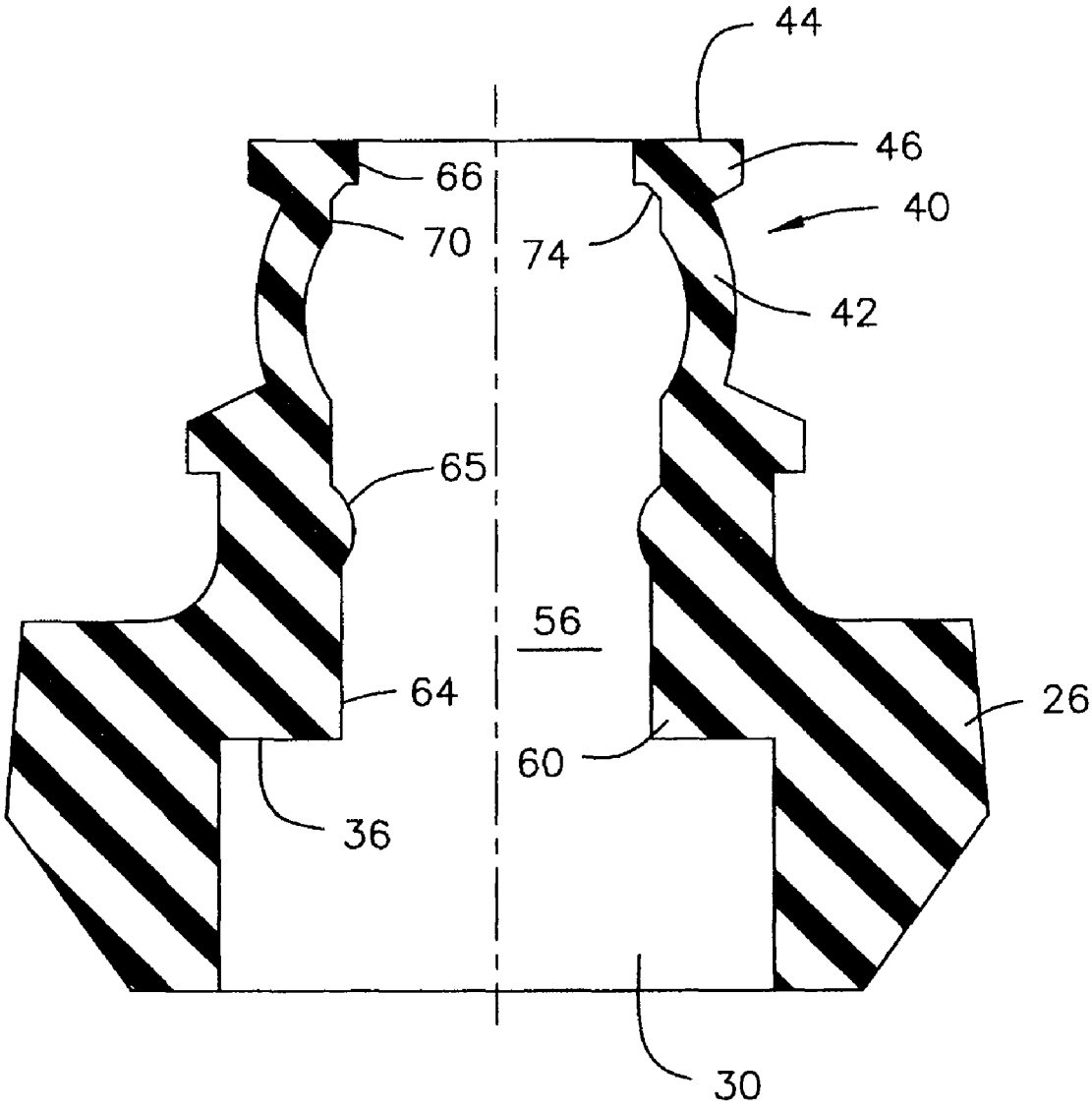
FIG. 7 is a longitudinal sectional view of the grommet in its relaxed state.

The sealing grommet 26 is a resilient material such as an elastomer or rubber, examples of which are sold under the trademarks Santoprene and Hytrel. As may best be seen in FIG. 7, the annular grommet 26 contains an inner bore 56 having a surface 64 which engages the lower portion of the valve stem 24 from the button 28 up to at least the upper end of the valve stem openings 32. This engagement between the grommet surface 64 bore and the valve stem 24 is an interference fit engagement. For example, for a valve stem 24 having a diameter of approximately 152 mils, the diameter of the surrounding grommet surface 64, when the grommet is in its unassembled relaxed state, is about 10 mils less. This provides approximately a five mil interference fit on a radius.

The corner 60 of the grommet 26 is designed to have an orthogonal intersection between the bore 56 and the horizontal surface 36 of the grommet.

The surface 36 of the grommet 26 has a one degree (1°) taper extending up from the radial inmost point to the outer corner. This provides initial contact on closing at the innermost radius of grommet and button. This taper provides a more effective seal.

When the valve stem 24 is depressed by manual pressure of the user, the valve stem openings 32 are moved partially or wholly out of engagement with the grommet bore 56 surface 64. This movement can be a partial or a complete disengagement of the openings 32. The user can thus adjust the rate at which product is dispensed by the amount that the valve stem 24 is moved down in an axial direction.

The interference fit relationship between the grommet surface 64 and the zone of the openings 32 is crucial to assure that a partial opening of the valve can be achieved. The interference fit relationship assures that the portion of the valve stem opening 32 that continues to be blocked by the grommet surface 64 will be effectively blocked and will not be opened by pressure of the product being dispensed.

Figure 6:
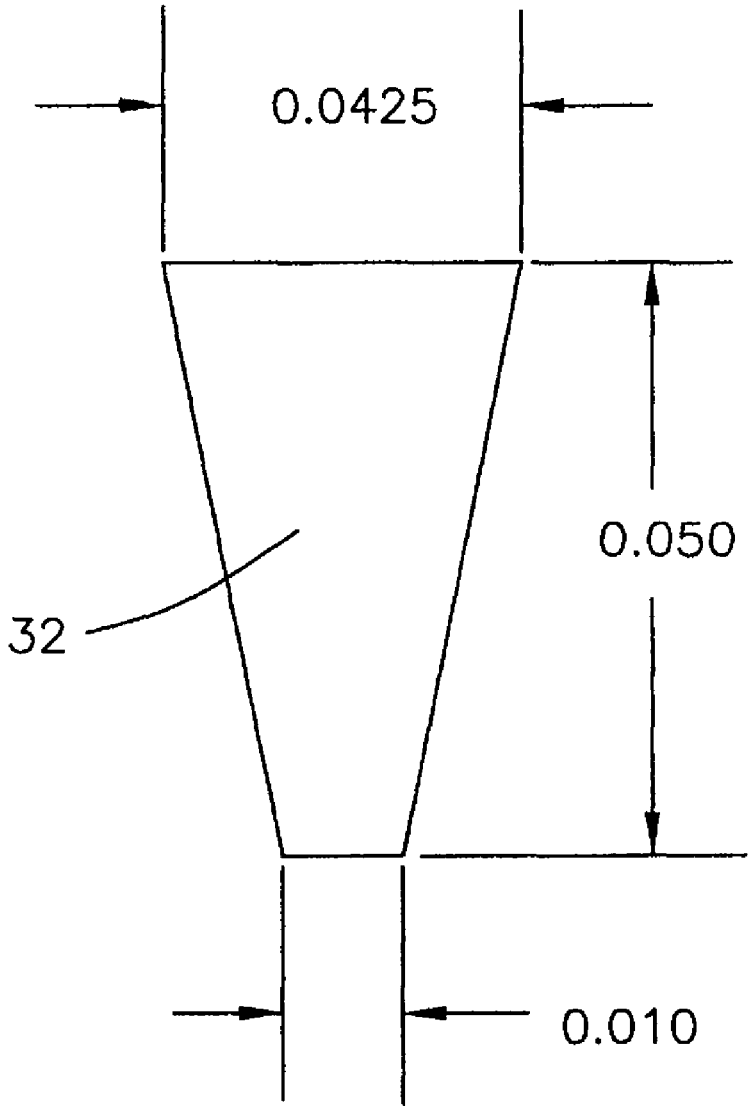
FIG. 6 illustrates the dimensions of a preferred stem wall opening 32 in one embodiment.

The openings 32 are shown in detail in FIG. 6. When compressed air or compressed nitrogen is employed, the pressure drops as product is dispensed because the volume of the pressurized chamber increases. The dimensions of the openings 32 increase in both directions (axially and transverse thereto). As the valve is depressed, this geometry provides enhanced comfort and control for the user. The openings 32 geometry shown is an inverted triangle. This has been found to be useful; particularly when dispensing a product such as a gel shave.

The grommet 26 has a recess 30 in its base into which the valve button 28 fits. The diameter of the button 28 and the diameter of the recess 30 have a slip fit relationship. For example, a button with a 250 mil diameter and a grommet recess with a 251 mil diameter is representative of the essentially slip fit relationship involved. This fit helps to dimensionally stabilize the valve, minimize any tendency to tilt and thereby assists in providing control over the amount by which the openings 32 are opened and thus control of the rate at which product is dispensed. The recess 30 is deep enough so that the button 28 stays within the recess at the fully open valve state.

Figure 5:
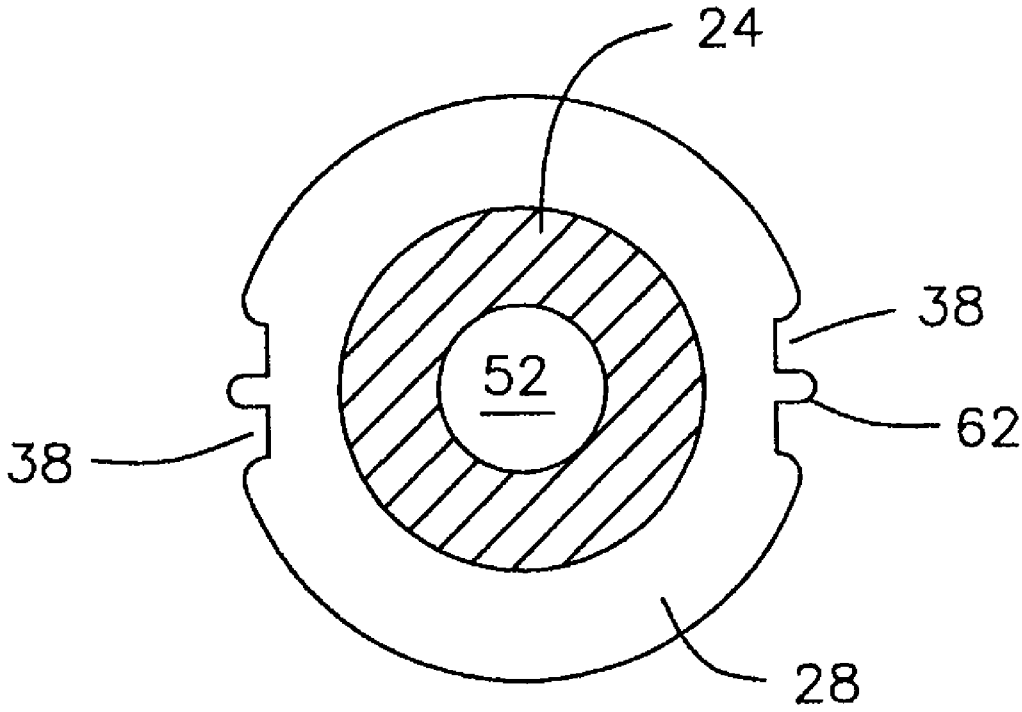
FIG. 5 is a cross sectional view along the plane 5-5 of FIG. 4 showing the preferred form of the edge recesses 38 in the button 28.

The edge openings 38 in the button 28 have the configuration shown in FIG. 5 in which a protrusion 62 bifurcates the openings 38. This is in one embodiment in order to facilitate automatic assembly. It is important, though, that the total cross sectional area of the two recess openings 38 be at least equal to the total area of the two valve stem openings 32 to avoid any additional restriction on the flow of product.

Upon initial opening, a small space is created between button surface 34 and grommet surface 36. This space has to fill with product before product can be dispensed through the stem wall openings 32. Applicant believes that this accumulation of product in that space helps to assure the initial dispensing of product will be close to the rate selected by the user. For this effect to occur, it is believed important that the area of the edge openings 38 in the button 28 be approximately equal to the area of the stem openings 32.

An annular sealing bump 65 prevents product from seeping up into the upper part of the grommet 26 and stem 24.

The upper portion of the grommet 26 is called a boot 40. A center section or leg 42 of this boot collapses under vertical pressure, as shown in FIG. 3, so as to permit the valve stem 24 to move down and place the valve stem openings 32 in communication, through the button edge recesses 38, with the product to be dispensed.

This opening and closing of the valve involves an engagement between the upper surface 44 of the foot 46 of the boot 40 and a downwardly facing surface 48 of the shoulder 50 in the valve stem 24. The shoulder 50 engages the foot 46 so that the boot leg 42 buckles outwardly when finger pressure is applied to force the stem 24 in a downward direction. But the resilient nature of the grommet material pushes the boot leg 42 up once finger pressure is removed thereby closing the valve.

The valve is held closed by a combination of pressure underneath the button 28 from the pressurized material in the container and the restoring force provided by the compressed boot leg 42. Further, the distance from (a) button 28 to shoulder 50 in the stem is greater than the distance (b) in the relaxed grommet 26 from foot surface 44 to the surface 36 in the recess 30. This assures a restoring force exerted by the leg 42 at the lowest pressure when product is nearly all dispensed.

When the valve is open, as shown in FIG. 3, the passage of the Product P is through the button edge recesses 38 (see FIG. 5) through the openings 32 in the valve stem, then up the center passage 52 in the valve stem 12 and out through the nozzle actuator 20.

A problem that occurs in connection with these vertically actuated valve stem designs is that in certain circumstances the pressure required to open the valve is sufficiently great so that the upper foot 46 of the boot 40 can occasionally snap around the shoulder 50 thereby essentially disabling the valve and holding it open.

The design shown overcomes this potential loss of proper engagement between boot 40 and shoulder 50 by providing engagement between an inwardly facing annular flange 66 formed as part of the foot 46 at the top of the boot 40 and an annular recess 54 in the stem 24. Because of the small sizes of the flange 66 and recess 54, dictated by the small size of the entire valve structure, it is important that various dimensional relationships be selected to assure that the boot flange 66 is fully inserted into the stem recess 54. In order to achieve this full insertion result and in view of the inevitable variations due to tolerance and manufacture, the following relationships have been found to be valuable and are preferred.

Figure 8:
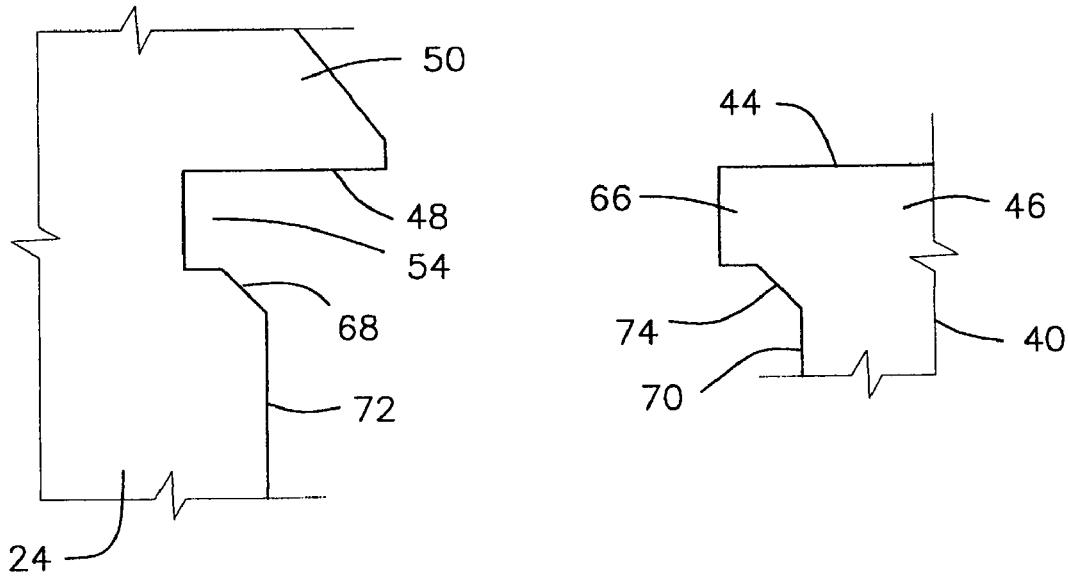
FIG. 8 is a larger scale view of the boot flange 66 and stem recess 54. It is an exploded view to best show the relationship between the flange and recess.

It is important that the opening of the annular recess 54 be greater than the thickness of the flange 66 so that the recess opening will not obstruct the full insertion of the flange. It is the engagement between the upper surface 44 of the boot and the lower surface 48 of the shoulder 50 that brings about opening and closing. Thus a tight fit between flange 66 and recess 54 is of little significance and could actually create resistance to the full insertion of the flange 66 into the recess 54. As shown in FIG. 8, this dimensional relationship is arranged by having a sloping surface 68 for the lower surface of the recess 54.

A further feature that aids in assuring the full insertion of the flange 66 into the recess 54 is to have an interference fit relationship between the annular surface 70 of the boot immediately below the flange 66 and the corresponding annular surface 72 of the valve stem 24. This assures that no part of the flange 66 is outside of the recess 54. It is also useful that the recess 54 extend inwardly nominally more than the length of the flange 66 and that the inner thickness of the recess 54 be at least nominally greater than the thickness of the inner edge of the flange 66. These two clearance relations work together to assure room for the flange 66 in the recess 54 and thus removes the possibility that the flange will not fully sit within the recess. These two clearances also provide room to accommodate flange distortion under pressure when the valve is opened.

The stem diameter at the wall 72 just below the recess 54 is greater than the corresponding boot diameter. The design value in one embodiment are that the stem diameter is 152 mils and the corresponding boot diameter is 148 mils. This four mil diameter difference serves to compensate sufficiently for manufacturing tolerances and to assure that the entire flange will be inserted into the stem recess.

In large part for reasons of assembly of grommet and stem, the diameter of the shoulder 50 cannot be as great as might be desired for the purpose of assuring that the boot does not snap over the shoulder. It becomes useful to make sure that the upper surface 44 of the boot extends radially outward to at least the outer end of the downwardly facing surface of the shoulder 50. This provides as much of an engagement surface as possible thereby minimizing unit pressure area and further helping to assure that the forces between boot 40 and shoulder 50 are resolved to reduce the tendency for the boot to snap over the shoulder.

A 45 degree fillet 74 at the corner of the flange 66 and boot wall 70 serves to guide and keep the flange 66 in place. The 45 degree surface 68 at the recess opening provides room to accommodate the fillet 74.

Figure 4:
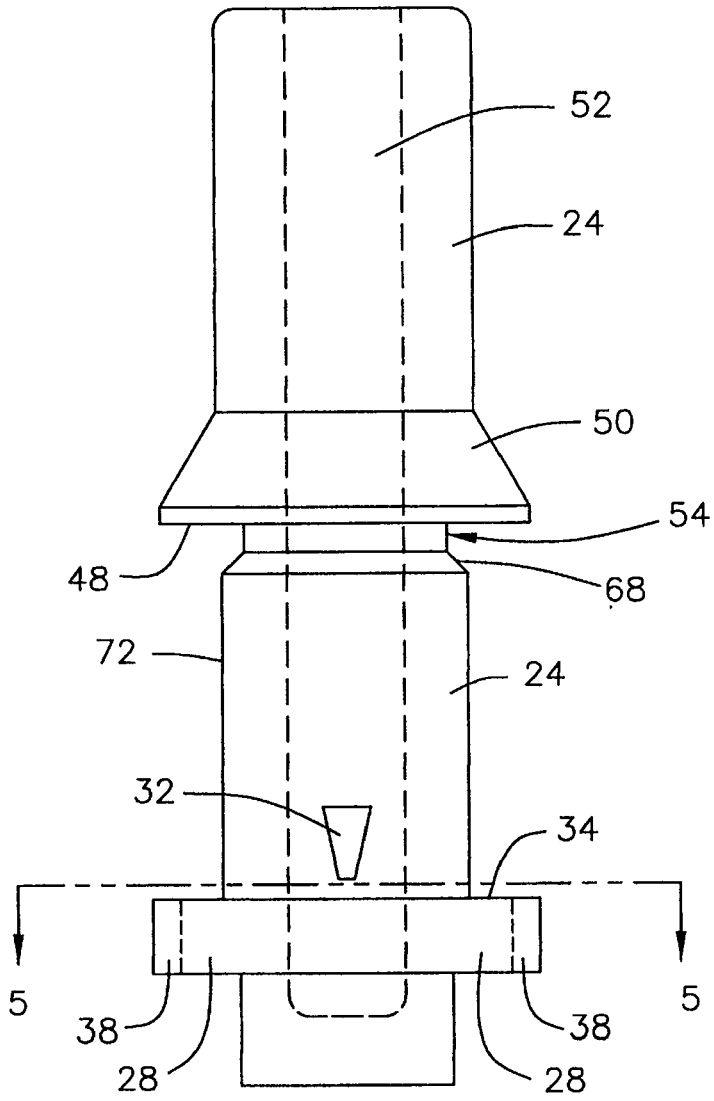
FIG. 4 is an elevational view of the movable valve element 24 which is also called the stem. It includes the stem opening 32, the button 28 and shoulder 50.

The valve stem opening 32 shown in FIG. 4 is deemed optimum for use with a liquid flowable product such as a gel shave. By contrast, when adapting the invention to other products, it may be preferable to employ a more rectangular valve stem opening 32A such as shown in FIG. 4A.

The approximately triangular opening 32 of FIG. 4 permits the user to meter out the amount of product being dispensed by the extent to which the user depresses the valve stem. By contrast, for spray products, a minimum volume of liquid is required in order to effect an adequate spray from the spray head. If used for spray dispensing, the triangular opening 32 of FIG. 4 tends to result in a dribbling of product initially and at the end of the closing of the valve. The FIG. 4A rectangular opening 32A minimizes this problem.

In one product designed for a gel shave, the inverted triangular opening 32 has the dimensions shown in FIG. 6.

Figure 4A:
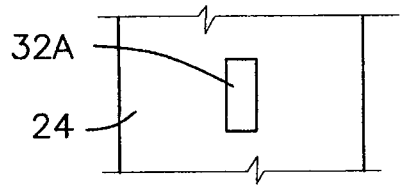
FIG. 4A shows an alternate valve stem opening 32A.

A typical valve stem opening 32A, such as is shown in FIG. 4A, for a product providing a spray or mist has a height of 50 mils and a width of 20 mils.

One Example of the Embodiment Disclosed

In one example of this embodiment, a product useful for dispensing gel shave has the following dimensions. For clarity and ease of presentation, the FIGS. are not proportional to the following typical dimensions.

The following is an example of a single embodiment of this invention in which the dimensional relationship discussed above are represented by a specific set of dimensions. The following provides an indication of the nominal nature of the interference and clearances which assure the full insertion of the flange 36 into the recess 38.

Grommet Recess 30: 251 mils in diameter and 115 mils deep.

Button 28: 250 mils in diameter and 50 mils thick. This provides a one mil on a diameter slip fit between button 28 and recess 30.

Valve Stem 24: 152 mils in diameter.

Grommet 26 inner diameter at the lower portion thereof: 142 mils in relaxed state thus providing a 10 mil interference fit on a diameter with the 152 mil valve stem 24.

Center Passageway 52 in valve stem: 70 mils.

Shoulder 50 Diameter and boot upper edge diameter: 230 mils.

Valve Stem Openings 32: see FIG. 6 for dimensions.

Boot Flange 66: 20 mils thick by 20 mils long.

Stem Recess 54: 20 mils thick by 22 mils deep.

Boot Inner Diameter 70 below Flange: 148 mils.

Interference between Boot 40 Diameter at the Wall 70 and Stem 54 Diameter below Recess (152 Minus 148): 4 mils on a diameter.

Clearance between Boot Flange 66 Thickness and Stem Recess 54 Width at their Inner Ends (22 minus 20): 2 mils.

Clearance between Boot Flange 66 Diameter and Stem Recess 54 Diameter (122 minus 124): 2 mils.

While the foregoing description and drawings represent the presently preferred embodiments of the invention, it should be understood that those skilled in the art will be able to make changes and modifications to those embodiments without departing from the teachings of the invention and the scope of the claims.

For example, the embodiment described is based on a design tested for dispensing a product like a gel shave. The invention could be employed for dispensing a wide range of products having a wide range of viscosities. Application of the invention to dispensing a mist or spray from a container using either a bag or a piston as the barrier member would preferably call for use of the FIG. 4A rectangular stem openings 32A. Otherwise such an adaptation would call for appropriate dimensional selections such as use of a smaller diameter center passageway 52, smaller sidewall openings 32 and smaller button edge openings 38.

What is claimed is:

1. A vertically movable valve for use with a pressurized product dispensing container wherein the valve is movable between an upper closed state and a depressed dispensing state, the valve having a valve stem with an axis and a button at its base, at least one dispensing opening in the lower zone of the valve stem and a resilient annular sealing grommet around the stem, comprising:

an annular boot portion at the upper end of the grommet, said boot having an annular foot at the upper end of said boot and an annular leg portion extending downwardly from said boot, a shoulder on said valve stem, said foot having an upper surface engaging said shoulder to provide a restoring force when said valve is depressed, a lower zone of the sealing grommet having an interference fit relationship with the valve stem at the dispensing opening, a recess in the base of the grommet to accept the button of the stem, said recess being deep enough so that said button is within said recess when the valve is in its fully open state, at least one recess in the edge of said button to provide product passageway for product when the valve is open, the vertical distance between said stem shoulder and the stem button is less than the vertical distance between said upper surface of said grommet foot and said surface of said grommet base recess that engages said button.

2. The valve of claim 1 wherein: said at least one dispensing opening of the stem has an elongate shape in the direction of the axis of the stem and also has a transverse opening distance that is greater at the upper part of the opening and lesser at the lower part of the opening.

3. The valve of claim 2 further comprising:

a radial inwardly extending flange on said foot, an annular recess on said stem, said recess adjacent to and below said shoulder, said foot and said stem recess engaging to provide insertion of said flange into said recess, said stem recess having an opening width greater than the thickness of said foot flange, the inner diameter of said boot below said foot flange has an interference fit relative to the outer diameter of said stem below said recess to assure full insertion of said flange into said recess.

4. The valve of claim 3 wherein: the upper surface of the button and the upper surface of said grommet recess have a radial tapered engagement providing for first contact at a radial inner zone and a final contact at a radial outer zone.

5. The valve of claim 1 further comprising:

a radial inwardly extending flange on said foot, an annular recess on said stem, said recess adjacent to and below said shoulder, said foot and said stem recess engaging to provide insertion of said flange into said recess, said stem recess having an opening width greater than the thickness of said foot flange, the inner diameter of said boot below said foot flange has an interference fit relative to the outer diameter of said stem below said recess to assure full insertion of said flange into said recess.

6. The valve of claim 1 wherein: said leg portion of said boot having a concave curved inner surface and a convex curved outer surface, said concave curved inner surface extending downward further than said convex outer surface.

7. The valve of claim 1 wherein: the upper surface of the button and the upper surface of said grommet recess have a radial tapered engagement providing for first contact at a radial inner zone and a final contact at a radial outer zone.

8. The valve of claim 1 wherein: said interference fit between the sealing grommet and the valve stem at said stem openings is approximately eleven mils on a diameter.

9. The valve of claim 1 wherein: said interference fit between said boot and the stem below said stem recess is approximately four mils on a diameter.

10. A vertically movable valve for use with a pressurized product dispensing container wherein the valve is movable between an upper closed state and a depressed dispensing state, the valve having a valve stem with an axis and a button at its base, at least one dispensing opening in the lower zone of the valve stem and a resilient annular sealing grommet around the stem, the grommet having a surface that engages the button in the closed state, comprising:

an annular boot portion at the upper end of the grommet, said boot having an annular foot at the upper end of said boot and an annular leg portion extending downwardly from said boot, a shoulder on said valve stem, said foot having an upper surface engaging said shoulder to provide a restoring force when said valve is depressed, said foot providing an inwardly extending radial flange, an annular recess on said stem, said recess adjacent to and below said shoulder, said foot and said stem recess engaging to provide insertion of said flange into said recess, said stem recess having an opening width greater than the thickness of said boot flange, the inner diameter of said boot below said foot flange has an interference fit relative to the outer diameter of said stem below said recess to assure full insertion of said flange into said recess, and said leg portion of said boot having a concave curved inner surface and a convex curved outer surface, said concave curved inner surface extending downward further than said convex outer surface.

11. The valve of claim 10 wherein: the vertical distance between said stem shoulder and the stem button is less than the vertical distance between said upper surface of said grommet foot and the grommet surface that engages said button.

12. The valve of claim 11 wherein: The outer diameter of the upper edge of said foot is at least equal to the outer diameter of said shoulder.

13. The valve of claim 10 wherein: the outer diameter of the upper edge of said foot is at least equal to the outer diameter of said shoulder.

14. The valve of claim 10 wherein: said interference fit between said boot and the stem below said stem recess is approximately four mils on a diameter.

15. A vertically movable valve for use with a pressurized product dispensing container wherein the valve is movable between an upper closed state and a depressed dispensing state, the valve having a valve stem with an axis and a button at its base, at least one dispensing opening in the lower zone of the valve stem and a resilient annular sealing grommet around the stem comprising:

a lower zone of the sealing grommet having an interference fit relationship with the valve stem at the dispensing opening, a recess in the base of the grommet to accept the button of the stem, said recess being deep enough so that said button is within said recess when the valve is in its fully open state, said recess having an upper surface that engages the button in the closed state, at least one recess in the edge of said button to provide product passageway for product when the valve is open, and the upper surface of the button and the upper surface of said grommet recess having a radial tapered engagement providing for first contact at a radial inner zone and a final contact at a radial outer zone, the vertical distance between said stem shoulder and said stem button being less than the vertical distance between said upper surface of said grommet foot and said upper surface of said grommet base recess.

16. The valve of claim 15 wherein: The area of said button edge recess is approximately equal to the area of the stem wall opening to provide an appropriate accumulator effect upon initial opening of the valve.

17. The valve of claim 16 wherein:

said interference fit between the sealing grommet and the valve stem at said stem openings is approximately eleven mils on a diameter, and said radial taper of said upper surface of said grommet recess is approximately one degree.

18. The valve of claim 15 wherein: said interference fit between the sealing grommet and the valve stem at said stem openings is approximately eleven mils on a diameter.

19. The valve of claim 15 wherein: said radial taper of said upper surface of said grommet recess is approximately one degree.

20. A vertically movable valve for use with a pressurized product dispensing container wherein the valve is movable between an upper closed state and a depressed dispensing state, the valve having a valve stem with an axis and a button at its base, at least one dispensing opening in the lower zone of the valve stem and a resilient annular sealing grommet around the stem comprising:

an annular boot portion at the upper end of the grommet, said boot having an annular foot at the upper end of said boot and an annular leg portion extending downwardly from said boot, a shoulder on said valve stem, said foot having an upper surface engaging said shoulder to provide a restoring force when said valve is depressed, said foot providing an inwardly extending radial flange, an annular recess on said stem, said recess adjacent to and below said shoulder, said foot and said stem recess engaging to provide insertion of said flange into said recess, said stem recess having an opening width greater than the thickness of said boot flange, the inner diameter of said boot below said foot flange has an interference fit relative to the outer diameter of said stem below said recess to assure full insertion of said flange into said recess, said leg portion of said boot having a concave curved inner surface and a convex curved outer surface, said concave curved inner surface extending downward further than said convex outer surface, a lower zone of the sealing grommet having an interference fit relationship with the valve stem at the dispensing opening, a recess in the base of the grommet to accept the button of the stem, said recess being deep enough so that said button is within said recess when the valve is in its fully open state, said recess having a downwardly facing upper surface, at least one recess in the edge of said button to provide product passageway for product when the valve is open, the vertical distance between said stem shoulder and said stem button being less than the vertical distance between said upper surface of said grommet foot and said surface of said grommet base recess the upper surface of said grommet recess having a slight radial taper to provide a shallow pyramid surface to engage the button in the closed state of the valve.

21. The valve of claim 20 wherein: The outer diameter of the upper edge of said foot is at least equal to the outer diameter of said shoulder.

22. The valve of claim 20 wherein: The area of said button edge recess is approximately equal to the area of the stem wall opening to provide an appropriate accumulator effect upon initial opening of the valve.

23. The valve of claim 20 wherein: said interference fit between the sealing grommet and the valve stem at said stem openings is approximately eleven mils on a diameter.

24. The valve of claim 20 wherein: said radial taper of said upper surface of said grommet recess is approximately one degree.

25. The valve of claim 20 wherein: said interference fit between said boot and the stem below said stem recess is approximately four mils on a diameter.

* * * * *